US005810132A

United States Patent [19]

Chang

[11] Patent Number: 5,810,132

[45] Date of Patent: Sep. 22, 1998

[54] RETRACTABLE HANDLE MOUNTING ARRANGEMENT

[76] Inventor: Fu-Cheng Chang, P.O. Box 82-144, Taipei City, Taiwan

[21] Appl. No.: 670,063

[22] Filed: Jun. 25, 1996

[51] Int. Cl.[6] ..... A45C 5/14

[52] U.S. Cl. ..... 190/18 A; 16/115

[58] Field of Search ..... 190/18 A, 115; 16/115; 280/47.29, 47.315, 47.371

[56] References Cited

U.S. PATENT DOCUMENTS

| | | | |
|---|---|---|---|
| 5,178,404 | 1/1993 | Chen | 16/115 X |
| 5,414,895 | 5/1995 | Kazmark, Jr. | 16/115 |
| 5,447,217 | 9/1995 | Chou | 16/115 X |
| 5,459,908 | 10/1995 | Chen | 16/115 |
| 5,461,756 | 10/1995 | Wang | 16/115 |
| 5,499,426 | 3/1996 | Hsieh | 16/115 |
| 5,502,876 | 4/1996 | Wang | 16/115 |
| 5,513,873 | 5/1996 | Chen | 16/115 X |
| 5,515,576 | 5/1996 | Tsai | 16/115 |

*Primary Examiner*—Allan N. Shoap
*Assistant Examiner*—Christopher J. McDonald
*Attorney, Agent, or Firm*—Alfred Lei

[57] ABSTRACT

A retractable handle mounting arrangement includes a top frame, a bottom frame, a retractable handle connected between the top frame and the bottom frame and a press control device mounted in the top frame and forced springs to lock the inner bars of the retractable handle. The press control device includes two control blocks forced by springs into engagement with the inner bars of the retractable handle. A hand pulls the control block inwards, causing them to release the inner bars of the retractable handle, allowing the retractable handle to be extended.

1 Claim, 5 Drawing Sheets

RETRACTABLE HANDLE MOUNTING ARRANGEMENT

BACKGROUND OF THE INVENTION

1. Field of the Invention

This invention relates to a retractable handle mounting structure for use in for example a travel bag. The retractable handle mounting arrangement uses two spring-forced sliding control blocks controlled by a press block to lock the retractable handle.

2. Description of the Prior Art

A travel bag may be equipped with wheels and a handle so that it can be moved on the ground with less effort. Because the handle of a regular travel bag has a limited length, it does not fit people of different heights. Therefore, the handles of newly developed travel bags are commonly made retractable so that they can be adjusted to the desired length. However, regular retractable handles for this purpose are not convenient to be released from the locking position.

SUMMARY OF THE INVENTION

This invention relates to a retractable handle mounting structure for use in for example a travel bag.

This invention provides a retractable handle mounting arrangement which positively locks the retractable handle in position, and permits the retractable handle to be conveniently released from the locking position. According to the present invention, the retractable handle mounting arrangement comprises a top frame, a bottom frame, a retractable handle connected between the top frame and the bottom frame, and a press control device mounted in the top frame and forced by spring means to lock the inner bars of the retractable handle, wherein the press control device comprises two control blocks forced by spring means into engagement with the inner bars of the retractable handle, and a spring-supported press block adapted for pressing by hand to pull the control blocks inwards, causing them to release the inner bars of the retractable handle, for permitting the retractable handle to be extended out.

DETAILED DESCRIPTION OF THE PREFERRED EMBODIMENT

Figure 1:
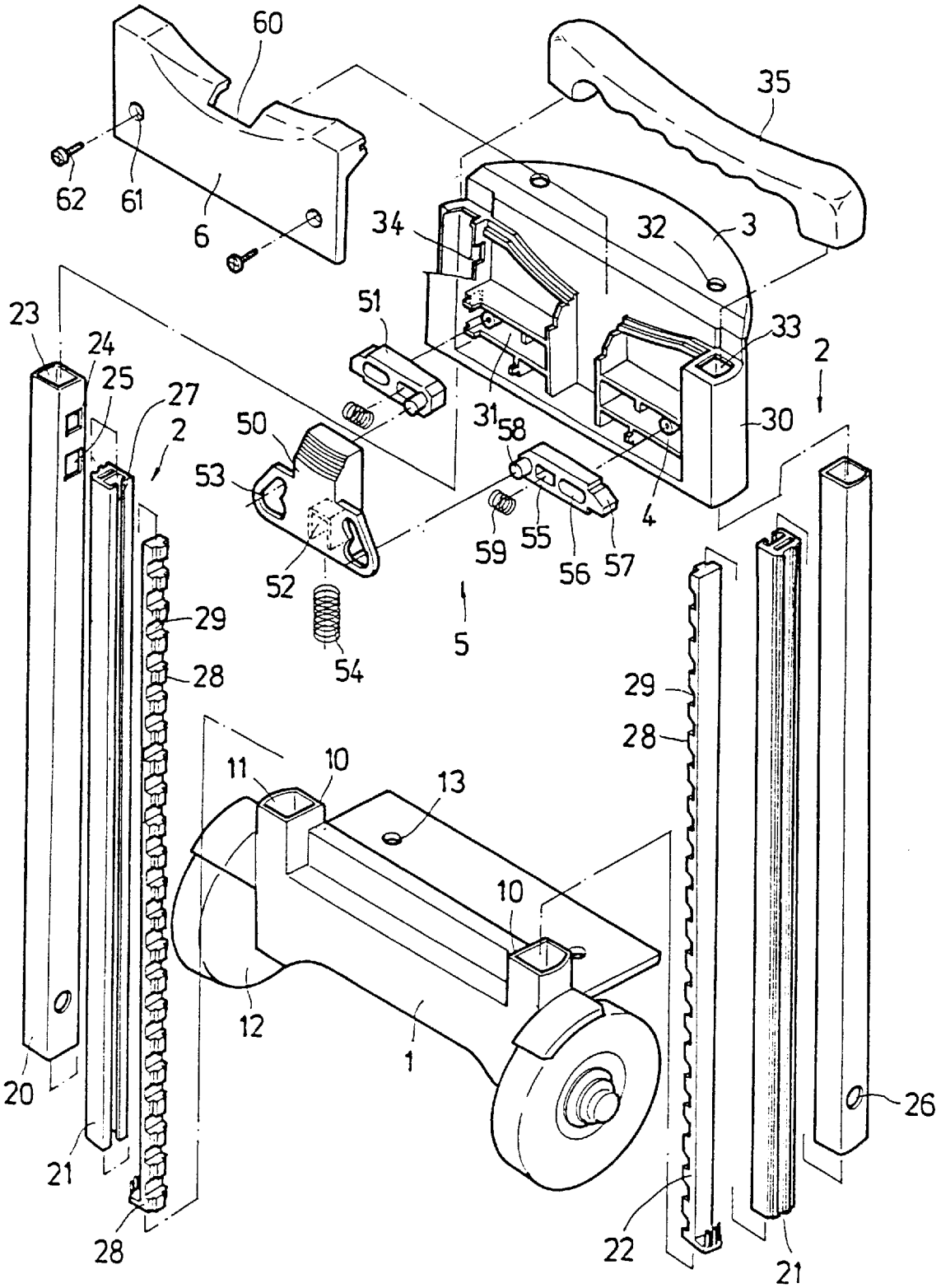
FIG. 1 is an exploded view of a retractable handle mounting arrangement according to the present invention.
Figure 2:
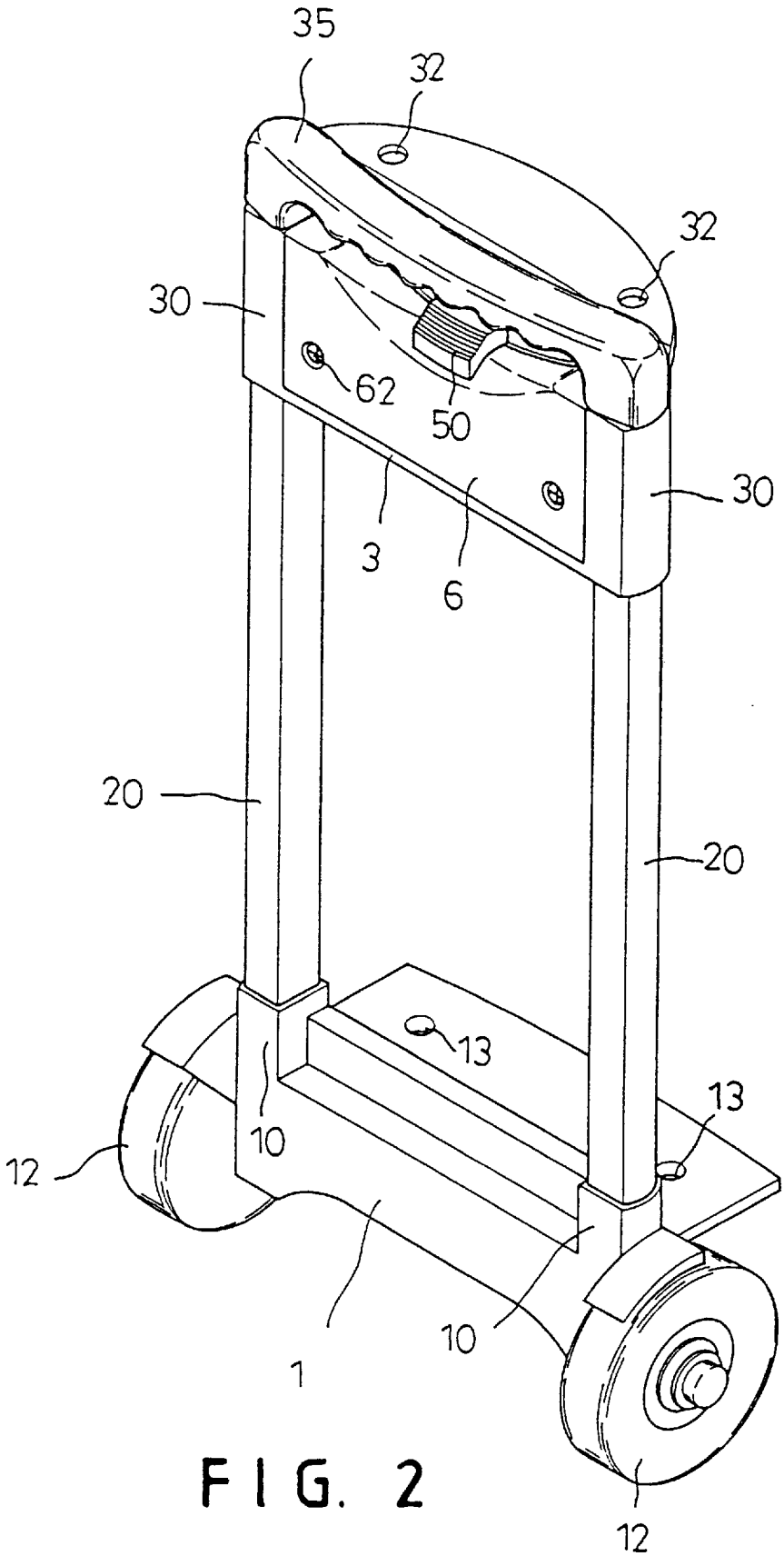
FIG. 2 is an elevational view of the present invention, showing the retractable handle mounting arrangement assembled.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Referring to FIG. 1, a retractable handle mounting arrangement in accordance with the present invention is generally comprised of a base frame 1, two retractable bars 2, a top frame 3, a press control device 5, and a cover 6.

The base frame 1 is equipped with a pair of wheels 12, having a plurality of mounting holes 13 adapted for fastening to the bottom panel of for example a travel bag, and two short upright posts 10 raised from the top at two opposite sides and defining a respective top coupling hole 11.

Each of the retractable bars 2 is comprised of an elongated outer sleeve 20, an elongated sliding track 21, and an elongated inner bar 22 that slide one inside another. The outer sleeve 20 comprises a longitudinal axle hole 23 through the length adapted for receiving the sliding track 21, a hook hole 24 at one side near the top, a mounting hole 26 near the bottom adapted for fastening to the upright posts 10 of the base frame 1, and a retaining hole 25 at the same side adjacent to the hook hole 24. The sliding track 21 slides in the longitudinal axle hole 23 of the outer sleeve 20, defining a longitudinal T-groove 27 through the length. The inner bar 22 slides in the longitudinal T-groove 27 of the sliding track 21, having raised blocks 28 and transverse grooves 29 alternatively spaced at one side along the length. When the inner bar 22 is inserted into the longitudinal T-groove 27 of the sliding track 21, the raised blocks 28 project out of the T-groove 27.

The top frame 3 comprises a plurality of mounting holes 32 at the top adapted for fastening to the top panel of the travel bag, two barrels 30 vertically disposed at two opposite sides and defining a respective longitudinal through hole 33 for mounting the hand grip, referenced by 35, and the retractable bar 2, and having a respective hooked portion 34 raised from the inside wall and projecting into the respective longitudinal through hole 33, two receiving chambers 31 bilaterally disposed between the barrels 30, two posts 4 respectively disposed in the receiving chambers 31, and two through holes 40 (not shown) respectively disposed in communication between the receiving chambers 31 and the longitudinal through holes 33 of the barrels 30.

The press control device 5 comprises a press block 50, and two control blocks 51. The press block 50 comprises a downward spring chamber 52, which receives a compression spring 54 that imparts an upward pressure to the press block 50, and two oblique guide slots 53 at two opposite sides. Each of the control blocks 51 comprises a spring chamber 55, which receives a return spring 59 that imparts an outward pressure to the respective control block 51, an oblong locating hole 56 adjacent to the spring chamber 55, a beveled stop portion 57 raised from the front end, and a stub rod 58 near the rear end.

The cover 6 is adapted for covering on the top frame 3, having a top opening 60, and two mounting holes 61 adapted for fastening to the top frame 3 by fastening elements for example screws 62.

The assembly process of the present invention is outlined hereinafter with reference to Figures from 1 to 3. The inner bars 22 and the sliding tracks 21 are mounted in the outer sleeves 20 respectively, permitting the raised blocks 28 to project out of the T-groove 27. Then, the bottom ends of the outer sleeves 20 are respectively inserted into the top coupling holes 11 of the upright posts 10 of the base frame 1, and the top ends thereof are respectively inserted into the longitudinal through holes 33 of the barrel 30 of the top frame 3, permitting the hook holes 24 to be respectively forced into engagement with the hooked portions 34 and the retaining holes 25 to be respectively aligned with the through holes 40 of top frame 3. Then, the control blocks 51 are respectively mounted in the receiving chambers 31 by coupling the oblong locating holes 56 to the posts 4. Then, the return springs 59 are respectively mounted in the spring chambers 55 to impart an outward pressure to the respective control blocks 51, causing the beveled stop portions 57 of the control blocks 51 to be forced into the through holes 40 and the retaining holes 25. Then, the compression spring 54 is mounted in the spring chamber 52 of the press block 50, and then the press block 50 is mounted in the top frame 3 by coupling the oblique guide slots 53 to the stub rods 58. Then, the cover 6 is covered on the top frame 3, and fixed in place by fastening the mounting holes 61 to the posts 4 by a respective screw 62. Finally, the hand grip 35 is fastened to the sliding tracks 21 and the inner bars 22 outside the top frame 3. When assembled, the press block 50 partially projects out of the top opening 60 of the cover 6.

Figure 3:
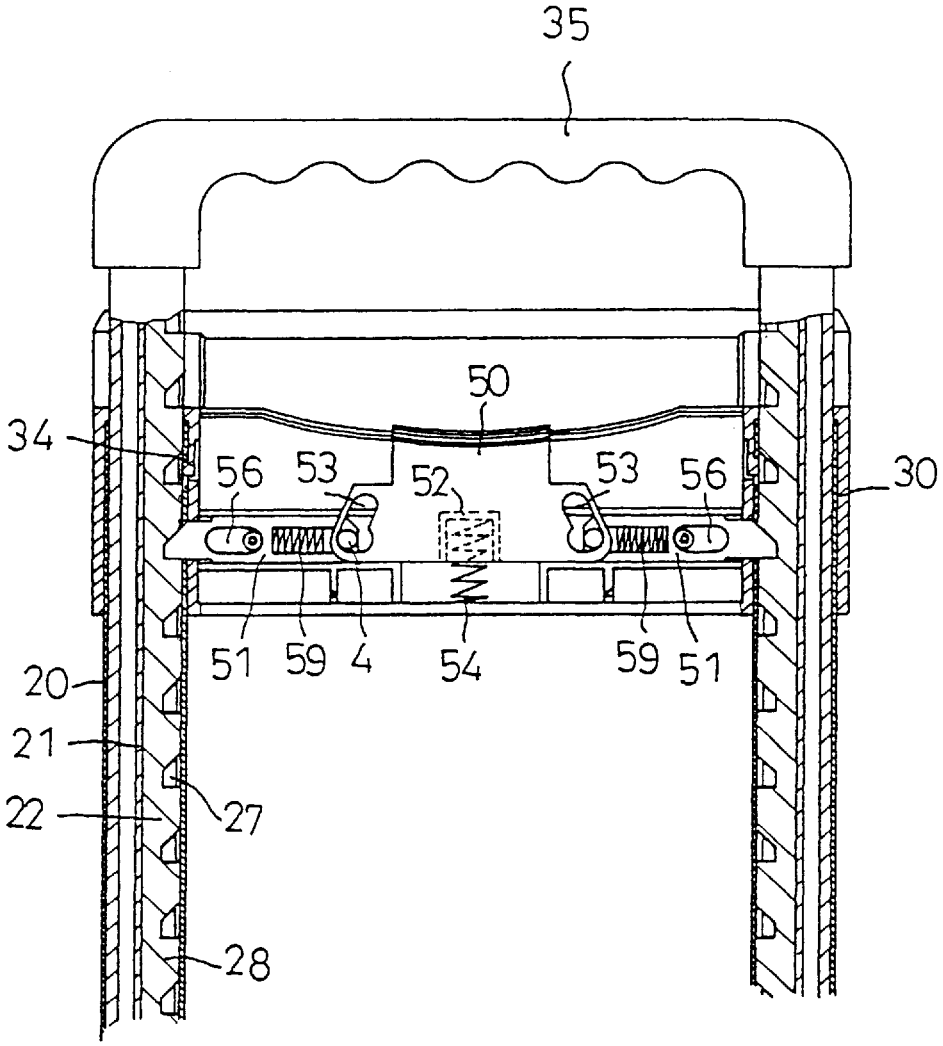
FIG. 3 is a sectional view of the retractable handle mounting arrangement of FIG. 2.

Referring to FIG. 3 again, when the beveled stop portions 57 of the control blocks 51 are inserted into the through holes 40 and the retaining holes 24, they are forced into engagement with the raised blocks 28 of the inner bars 22, therefore the inner bars 22 are stopped from being pulled outwards to extend the length of the retraceable bars 2.

Figure 4:
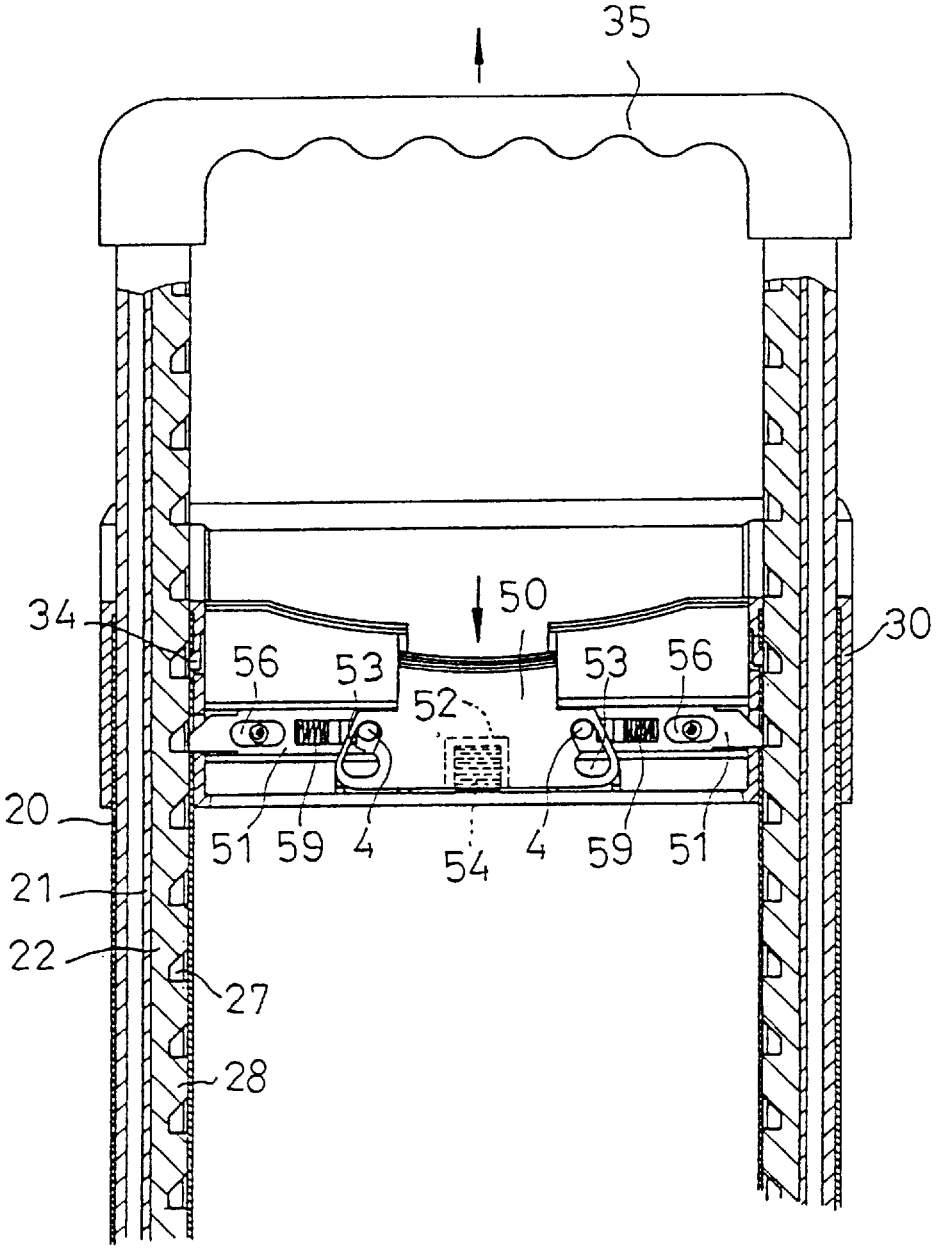
FIG. 4 is similar to FIG. 3 but showing the press block depressed, and the hand grip pulled upwards from the top frame.

Referring to FIG. 4, when the press block 50 is depressed, the compression spring 54 is compressed, and the stub rods 58 of the control blocks 51 are guided by the oblique guide slots 53 to move the control blocks 51 inwards toward each other, causing the beveled stop portions 57 to move away from the transverse grooves 29 of the inner bars 22, therefore the retractable bars 2 can be extended out by pulling the hand grip 35.

Figure 5:
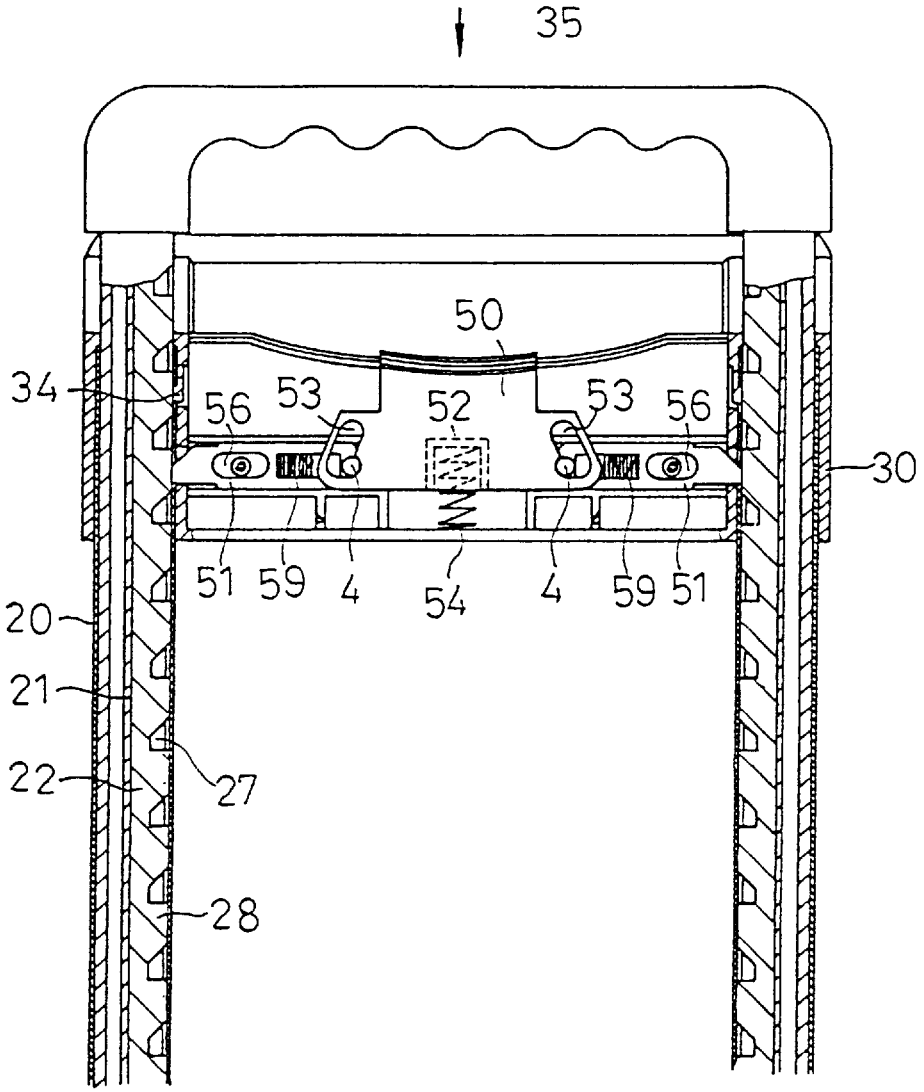
FIG. 5 is another sectional view of the present invention, showing the hand grip lowered.

Referring to FIG. 5, if to shorten the axial length of the retractable bars 2, it is achieved simply by pressing the hand grip 35 downwards to force the control blocks 51 inwards from the transverse grooves 29 of the inner bars 22.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A retractable handle mounting arrangement comprising a wheeled base frame and a top frame adapted for fastening to a bag at different elevations, said base frame comprising two upright posts defining a respective coupling hole, said top frame comprising two barrels vertically disposed at two opposite sides and two posts horizontally spaced between said barrels, each of said barrels having a longitudinal through hole and a transverse through hole at an inner side in communication with the longitudinal through hole, two retractable bars respectively mounted between the longitudinal through holes of the barrels of said top frame and the coupling holes of the upright posts of said base frame, and a hand grip connected between said retractable bars above the barrels of said top frame, and a press control device mounted slidably coupled to the posts of said top frame within a cover for locking said retractable bars, wherein;

each of said retractable bars is comprised of an elongated outer sleeve connected between the barrels of said top frame and the upright posts of said base frame, an elongated sliding track inserted into the longitudinal through holes of the barrels of said top frame and sliding in said outer sleeve and having a longitudinal T-groove, and an elongated inner bar mounted in said sliding track and having a series of longitudinally spaced raised blocks respectively projecting out of the T-groove of said sliding track, said sliding track and said inner bar having a respective top end extending out of the barrels of said top frame and connected to said hand grip, said outer sleeve having a through hole disposed in alignment with the transverse through hole of one barrel of said top frame;

said press control device comprises two control blocks mounted in said top frame and forced into the transverse through holes of said barrels and retaining holes of the outer sleeves of said retractable bars into engagement with the raised blocks of the inner bars of said retractable bars, two first springs respectively mounted in said top frame within said control blocks to impart an outward pressure to said control blocks and to force said control blocks into engagement with the inner bars of said retractable bars, a press block mounted in said top frame and adapted for pressing by hand to move said control blocks inwards and to simultaneously disengage said control blocks from the inner bars of said retractable bars, and a second spring mounted in said top frame within said press block to impart an upward pressure to said press block, said press block comprising a downward spring chamber, which receives said second spring, and two oblique guide slots at two opposite sides, each of said control blocks comprising a spring chamber, which receives one of said first springs, an oblong locating hole slidably coupled to one post of said top frame, a beveled stop portion corresponding to the through hole of one barrel of said top frame, and a stub rod inserted into one bevel guide slot of said press block.

* * * * *